United States Patent [19]

Tordenmalm

[11] Patent Number: 4,779,591

[45] Date of Patent: Oct. 25, 1988

[54] DEVICE FOR ENGINE SPEED SETTING IN A WORKING MACHINE

[75] Inventor: Lars Ö Tordenmalm, Södra Sandby, Sweden

[73] Assignee: Åkermans Verkstad AB, Eslov, Sweden

[21] Appl. No.: 887,108

[22] PCT Filed: Nov. 6, 1985

[86] PCT No.: PCT/SE85/00439

§ 371 Date: Jul. 7, 1986

§ 102(e) Date: Jul. 7, 1986

[87] PCT Pub. No.: WO86/02975

PCT Pub. Date: May 22, 1986

[30] Foreign Application Priority Data

Nov. 7, 1984 [SE] Sweden ..... 8405565

[51] Int. Cl.[4] ..... F02D 29/00; F02D 41/00

[52] U.S. Cl. ..... 123/352; 123/339; 123/357

[58] Field of Search ..... 123/339, 352–355, 123/357

[56] References Cited

U.S. PATENT DOCUMENTS 2,721,072 10/1955 Zuhn et al. .
4,370,961 2/1983 Brown ..... 123/352
4,372,265 2/1983 Kasiewicz ..... 123/352
4,373,850 2/1983 Durham ..... 123/386 X
4,422,420 12/1983 Cromas et al. ..... 123/352
4,638,779 1/1987 Kitada ..... 123/385
4,643,146 2/1987 Spriessler ..... 123/385 X

*Primary Examiner*—Tony M. Argenbright
*Attorney, Agent, or Firm*—Birch, Stewart, Kolasch & Birch

[57] ABSTRACT

A device for setting the speed of, in particular, an excavator engine which is to operate at a speed adapted to the type of work to be done and is automatically shifted to resting speed when no work is done. In this manner, fuel consumption and the disturbing effect of unnecessarily high noise levels are reduced. The setting device includes simple electronic control units and actuates the fuel-controlling lever of the engine fuel injection unit. A d.c. servo motor is connected to said fuel-controlling level and is supplied with a reference value signal corresponding to the desired engine speed. By manual activation of a push-button on the control lever, the device provides the possibility of manually stepping the engine working speed upwards or downwards to at least three different levels. The device also includes a resting speed unit ("idling unit") having a preset high and preset low resting speed. If the manual control means of the machine are not activated for a given short period of time, the unit provides a high resting speed, and if no manual control means is activated for a further period of time, it provides a low resting speed. On activation of any manual control means, the engine resumes the actual working speed.

17 Claims, 5 Drawing Sheets

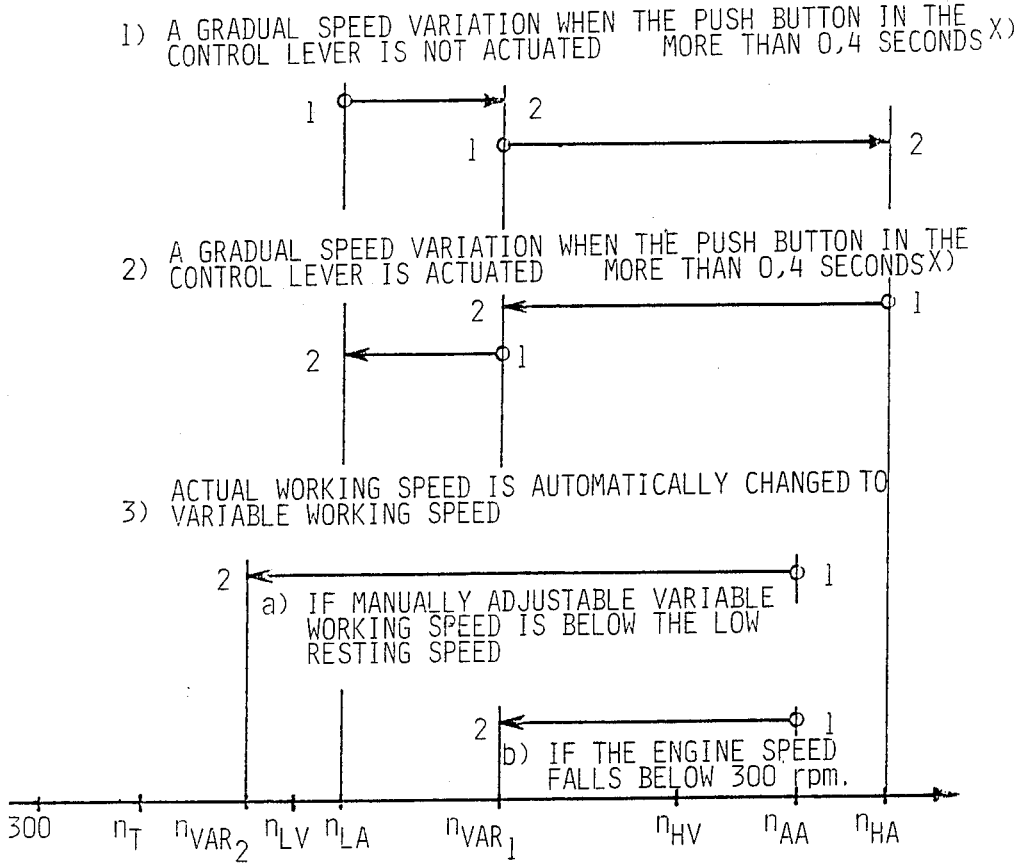

$n_T$ = IDLE RUNNING
$n_{VAR_1}$ = MANUALLY ADJUSTED VARIABLE WORKING SPEED
$n_{VAR_2}$ = NEW (e.g. FROM $n_{VAR}$) CHANGED VARIABLE WORKING SPEED
$n_{LA}$ = LOW WORKING SPEED
$n_{HA}$ = HIGH WORKING SPEED
$n_{LV}$ = LOW RESTING SPEED
$n_{HV}$ = HIGH RESTING SPEED
$n_{AA}$ = ACTUAL WORKING SPEED
1 = REPRESENTS THE ENGINE SPEED BEFORE CHANGE
2 = REPRESENTS THE ENGINE SPEED AFTER CHANGE
x) = THE CHANGE OF THE SPEED ONLY OCCURS IF MANUALLY ADJUSTED VARIABLE WORKING SPEED EXCEEDS THE LOW WORKING SPEED.

FROM THE DETERMINATION UNIT OF THE ENGINE SPEED POSSIBLE ACTUAL ENGINE WORKING SPEEDS WITH REGARD TO DIFFERENT INPUT VALUES.

FIG. 3

WHEN THE FUELMISER IS NOT CONNECTED THE REFERENCE SPEED VALUE CORRESPONDS TO THE ACTUAL ENGINE SPEED (u).

(e.g.d = 1, and f = 3)

$n_{LV}$ = LOW RESTING SPEED
$N_{HV}$ = HIGH RESTING SPEED
$n_{AA}$ = ACTUAL WORKING SPEED
$n_{HA}$ = HIGH WORKING SPEED

HOW THE FUELMISER UNIT EFFECTS THE REFERENCE SPEED VALUE (Y)

DEVICE FOR ENGINE SPEED SETTING IN A WORKING MACHINE

BACKGROUND OF THE INVENTION

The present invention relates to a speed setting device for setting the speed of a working machine and more particularly, for setting the speed in an excavator.

A diesel engine normally has a regulator for controlling, via a lever on the fuel injection pump, the amount of fuel supplied to the combustion chamber of the engine, to drive the engine at a predetermined speed. In an excavator, the engine usually is placed in the rear part of the hinged machine frame, and the above-mentioned speed control can be actuated manually and variably from the driver's seat by use of a hand-wheel, as well as by use of a pushbutton on the control lever, said hand-wheel and said push-button being adapted, via an electromechanical control system, to control the movement to the lever on the fuel injection pump.

During the excavating work, the engine should operate at a speed suitable for the type of work. Before or during excavation, the operator can set, for instance by use of the hand-wheel, an initial speed which, together with the speed control device, provides an operating speed suitable for the work. As soon as the operator actuates his controls to carry out excavation, the engine speed is increased automatically from resting speed to working speed. If required, the device permits manual stepwise increase/decrease of the engine speed during work and automatic return to resting speed when no work is carried out.

DESCRIPTION OF THE PRIOR ART

A prior art device for the above-mentioned speed control, Swedish Pat. No. 74 00 846-7, comprises a hydromechanical control means connected to the operating system of the work unit of the machine, where the system actuates the lever of the fuel injection pump. In this arrangement, the automatic engine control varies between a variably settable resting speed and the racing speed. This arrangement was intended to reduce automatically the engine speed when no excavating movement takes place, and to increase the motor speed when excavation is carried out. In this manner, fuel consumption is reduced and, at the same time, the direction of the high noise level period is also reduced. Other automatic idling systems in excavators utilise, in principle, a pneumatic cylinder, the piston rod of which is connected to the lever on the fuel injection pump of the engine. The cylinder is activated by means of a pressure control device in the hydraulic circuit, or by an electric switch on the control lever. These means provide for automatic control only between a resting speed/idling speed and a maximum speed.

SUMMARY OF THE INVENTION

The present invention affords completely different speed setting possibilities well suited to make excavation work more effective and to further minimise fuel consumption and to reduce the noise level of the machine. In addition, the present invention's electromechanical unit has few moving parts and may be readily adapted to different speed control patterns. The speed setting possibilities are realised by means of the arrangement as defined in the appended claims.

BRIEF DESCRIPTION OF THE DRAWINGS

The invention will be described in more detail below, reference being had to the accompanying drawings illustrating an embodiment.

DETAILED DESCRIPTION OF THE INVENTION

Figure 1:
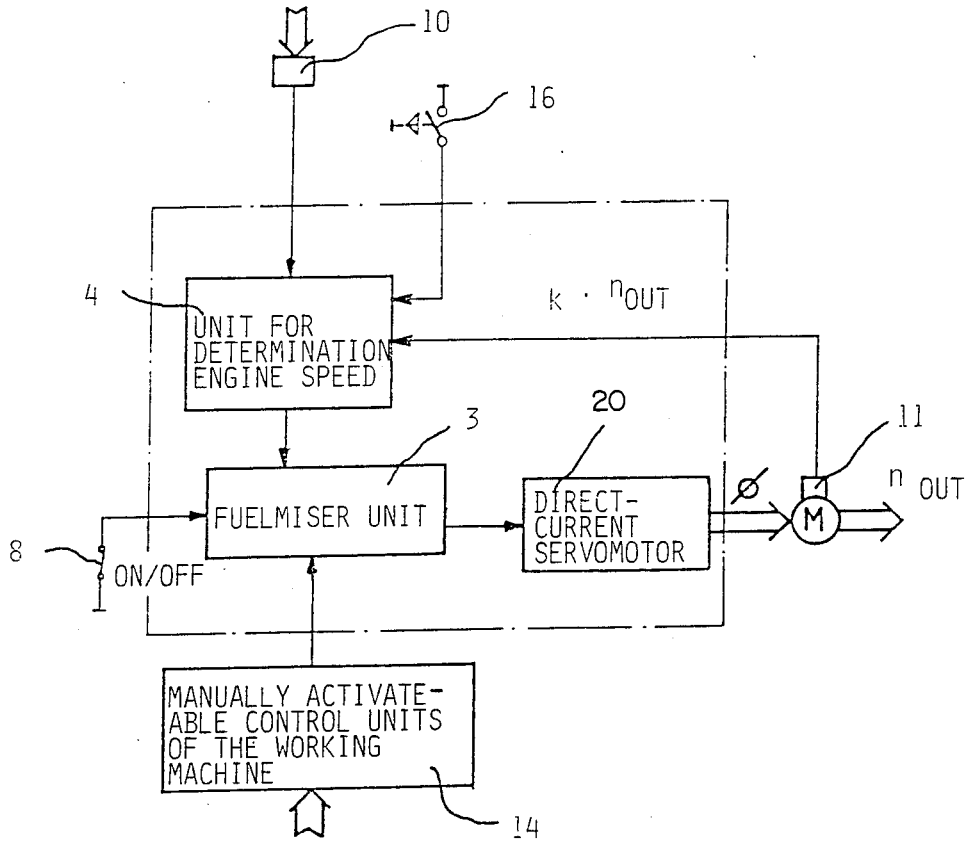
FIG. 1 provides, in the form of a block diagram, a basic functional description of the device, while FIG. 2 describes the function in more detail. The manner in which the speed is varied by means of different factors is illustrated in FIGS. 3 and 4.

The speed setting device according to the invention, which has been designed for internal combustion engines, especially diesel engines, in earth-working machines, comprises a system which is actuated in a specific manner and sets the diesel engine speed by means of a d.c. servo motor, the output shaft of which is fixedly connected to the control lever of the fuel injection pump of the diesel engine. A basic functional description of the system is given in FIG. 1.

The system, and thus the speed of the diesel engine, is actuated by the manual control means 14 (levers, pedals etc) of the machine, a push-button 16 on the control lever, and means 10 for manual setting of the engine speed. For changing the engine to fixedly set resting speeds when no excavating movement is carried out during machine operation, a so-called fuelmiser unit 3 is provided. The fuelmiser unit 3 can be manually connected or disconnected by means of a special switch 8. When the fuelmiser unit is disconnected, the dielel engine speed corresponds directly to the output signals from the speed determination unit 4 (i. e. the reference value corresponds to the actual working speed). The output diesel engine speed is indicated by a speed indicator 11. If required, the speed of the diesel engine M can be quickly changed manually by means of the push-button 16 on the control lever. The speed setting signals which determine the actual value to the d.c. servo motor 20 and which thus control the engine speed, are:

Accelerator setting (for instance a potentiometer on the instrument panel) 10.

Push-button on right-hand control lever 16

Diesel engine speed

Activated or unactivated levers/panels.

Figure 2:
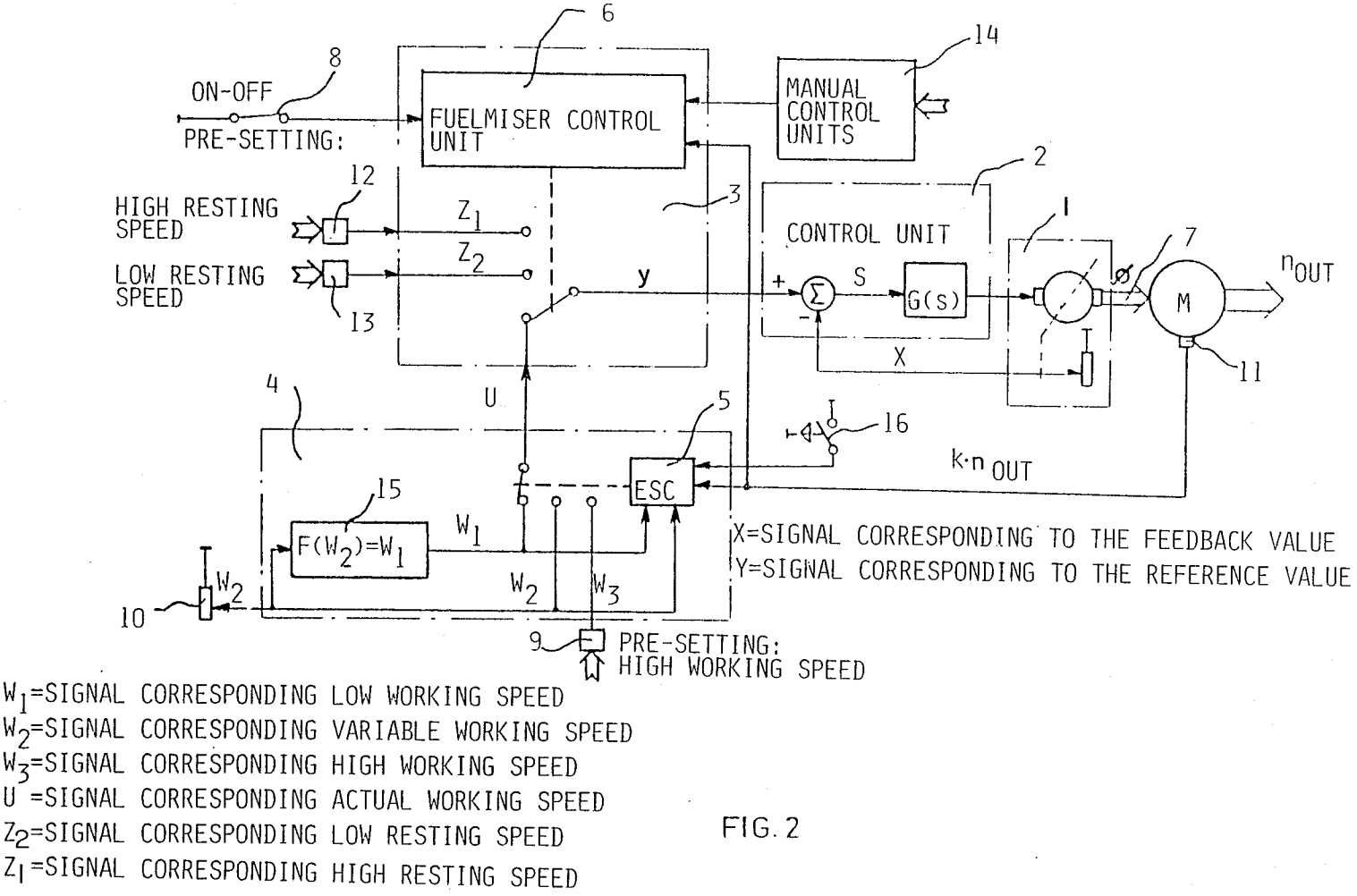

FIG. 2 illustrates in more detail the function of the speed setting device for the diesel engine of the excavating machine. The device comprises a d.c. motor unit 1, a regulator unit 2, a fuelmiser unit 3 with a control unit 6 contained therein, a speed determination unit 4 comprising an Engine Speed Control unit ESC 5 and a signal converter 15. The d.c. motor unit 1 which has an output shaft including a gear and a sensor or transducer showing the rotation of the motor unit output shaft, is fixedly connected to the control lever 7 of the fuel injection pump of the diesel engine, said pump controlling the engine speed. The d.c. motor unit 1 sets the control lever 7 for engine speed control by means of the regulator unit 2, whose input signal y (reference value) of which is determined by the speed determination unit 4 and the fuelmiser unit 3. The feedback value x of the regulator unit 2 corresponds to the angle of rotation $\phi$ of the output shaft of the d.c. motor unit 1. The feedback value x is indicated by, for example, a rotary potentiometer of linear characteristic. To prevent overspeeding of the diesel engine when full speed (so-called racing speed) is set, there is provided an adjustable fixed stop which the lever 7 strikes in the event of a movement greater than the angular deflection of full speed. The output signal u (input signal to the fuelmiser unit 3) of the speed determination unit 4 preferably corresponds to the determined actual working speed of the diesel engine. The input signals of the speed determination unit 4 are an input signal from the speed setting device 10 and from the speed indicator 11 of the diesel engine, and a constant input signal from the setting means 9.

The actual engine speed (low, variable or high) is indicated on, for example, a display in the driver's cabin.

By means of the control unit 5, the ESC (Engine Speed Control), the output signal u corresponding to the actual working speed may be obtained for three predetermined working speeds. One of these working speeds, the variable working speed $w_2$, is manually and variably settable from the driver's seat. The variable working speed is determined by, for example, the handwheel for setting the accelerator 10 on the instrument panel. The handwheel is turned fully clockwise to give the diesel engine working speed corresponding to full-load engine speed (so-called racing speed), and completely counter-clockwise gives the lowest engine speed (idling speed). Furthermore, manual changing of the actual working speed to the nearest higher/lower working speed (for example $w_2$ to $w_3$, or $w_2$ to $w_1$) can be effected by means of, for example, a push-button 16 in the right-hand control lever. The output signal of the speed determination unit 4 corresponds to three possible actual working speeds:

1. Low working speed
2. Variable working speed
3. High working speed.

The low working speed (corresponding to the signal $w_1$) is obtained by direct signal conversion in the signal converter 15 of the variable speed (corresponding to the signal $w_2$) settable from the driver's seat. The high working speed (corresponding to signal $w_3$) is obtained by means of the setting means 9 (for example a potentiometer) which is set to a value corresponding to the racing speed of the diesel engine.

The control unit 5, the ESC (Engine Speed Control) of the speed determination unit 4 changes the actual working speed if, due to actuation of the manually settable speed setting device 10, the variable working speed exceeds a predetermined value of the low working speed (for example about 900 rpm), in the manner described below for the embodiment also illustrated in FIG. 3.

1. Changing the actual working speed to the next higher possible speed (from low to variable working speed, or from variable to high working speed) occurs when the push-button 16 on the right-hand lever has been activated for at most 0.4 second.
2. Changing the actual working speed to the next lower possible speed (from high to variable working speed, or from variable to low working speed) occurs when the push-button 16 on the right-hand control lever has been activated for more than 0.4 second.
3. Changing of the actual working speed to the variable speed occurs when the variable working speed falls below the low resting speed (about 900 rpm), or when the actual speed of the combustion engine falls below about 300 rpm.

The actual reference value for setting the diesel engine speed is finally determined by the fuelmiser unit 3, the input signals of which are obtained, from the speed determination unit 4 (signal u), from transducers or sensors in the manual control means 14 of the working machine, the engine speed indicator 11 and the fuelmiser switch 8. In operation, the fuelmiser unit can be connected or disconnected by the switch 8. This implies that, when the fuelmiser unit is disconnected, its input and output signals merely consist of the output signal u of the speed determination unit 4, i. e. the fuelmiser unit does not, in the disconnected position, control the engine speed (the reference value corresponds to the actual working speed).

The fuelmiser unit 3 is used for reducing the combustion engine speed from the actual working speed to the preset fixed resting speed, when the machine is not working, and for increasing the speed when the machine is working. The output signal y (the reference value of the regulator unit 2) of the fuelmiser unit 3 is then provided, by the control unit 6, with a signal corresponding to three alternative speed possibilities:

1. Low resting speed
2. High resting speed
3. Actual working speed

The low and high resting speeds are set at suitable constant values by the setting means 13 and 12.

The fuelmiser unit is inactive, i.e. its output signal corresponds directly to the output signal of the speed determination unit 4 (i. e. the reference value corresponds to the actual working speed) when the fuelmiser switch 8 on the instrument panel is in the "off" position;

the diesel engine speed is below 300 rpm;

the parking brake of a wheeled excavator is not in the excavating position.

Figure 4:
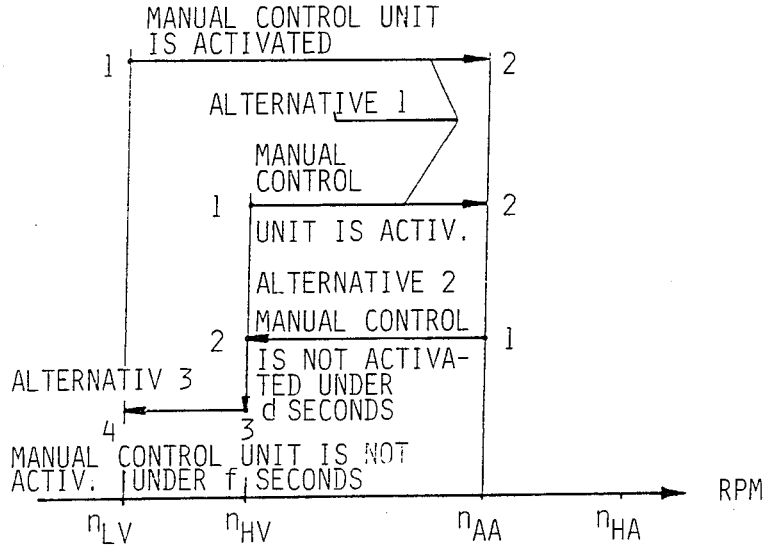

When the fuelmiser is disconnected, the reference value y corresponds to the actual working speed (signal u). When the fuelmiser is connected and active, the reference value speed is changed in the manner indicated below and shown in FIG. 4.

1. Changing of the reference value speed from the resting speed (low or high) to the actual working speed occurs when any control lever (for controlling boom, bucket, dipper arm, slew, and dozer blade movement) or pedal (for track movement forward/backward, or additional equipment) is activated by a movement greater than the dead band, i. e. a signal from lever/pedal movement greater than a given predetermined value.
2. Changing of the reference value speed from the actual working speed to high resting speed occurs when no lever or pedal has been activated for, for example, 1 second.
3. Changing of the reference value speed from high to low resting speed occurs when no lever or pedal has been activated for, for example, another 3 seconds.

Figure 5:
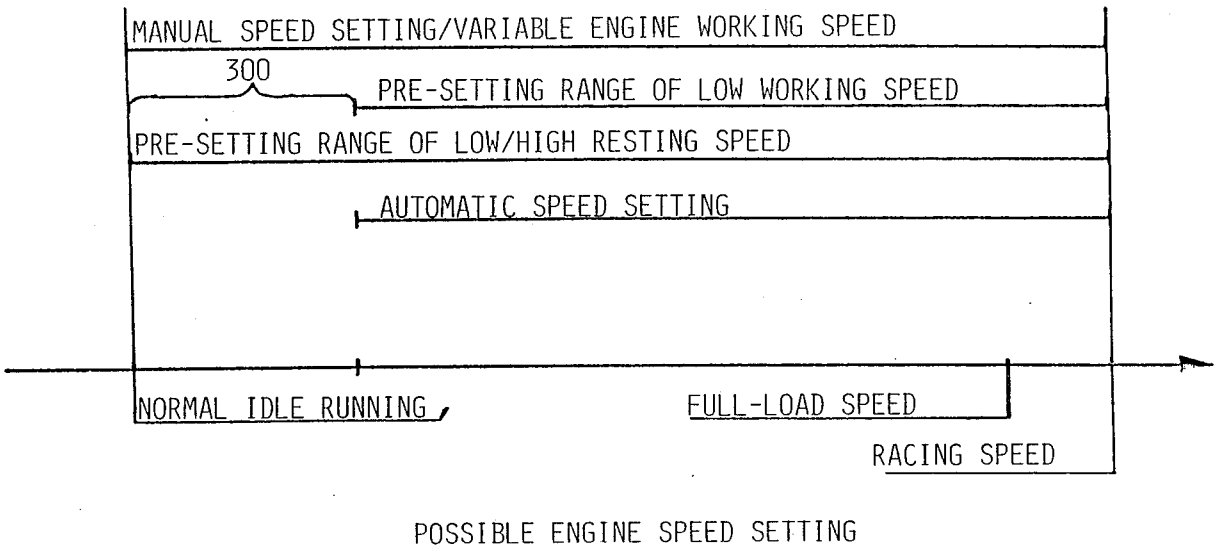
FIG. 5 shows possible engine speed settings.

FIG. 5 illustrates the different speed setting possibilities available. It should be noted that the fixed speeds (low/high resting speed and low/high working speed) preset for the automatic speed setting are placed in an order and a dimension such that the speed setting can be effected in the most convenient manner by means of the above-mentioned automatic setting possibilities. It appears from FIG. 4 that speed setting in the present case may occur either manually or automatically, and that the automatic setting may occur between a settable lower speed which is higher than (for instance 300) the idling speed and an upper engine speed limited by the racing speed.

Although the invention has been described above in its electrical application, it is, of course, possible to replace the means referred to at least partly by pneumatic or hydraulic means.

I claim:

1. A system for controlling the speed of an engine of working machine between at least one resting speed and at least two working speeds, the speed of said engine being adjusted by a speed regulator lever comprising:

first means for setting said at least one resting speed of the engine, second means for setting said at least two working speeds of the engine;

means for monitoring the actual speed of the engine;

speed selection means for selecting a desired speed from said at least one resting speed and said at least two working speeds set by said first and second means for setting;

driving means for varying the position of said speed regulator level of the engine;

control means, responsive to said desired speed from said selection means and responsive to said actual speed from said means for monitoring, for providing electrical setting signals to said driving means to vary the position of said speed regulator level of said engine to maintain said actual speed at said desired speed;

said speed selection means shifting said desired speed between said working speeds in response to activation of a speed selection switch;

said speed selection means further monitoring a working operation of said working machine and shifting said desired speed to said at least one resting speed when said working operation is not being performed.

2. The system of claim 1 wherein said speed selection means selects a working speed as the desired speed when a working operation is selected.

3. The system of claim 1 wherein said engine is a diesel engine, wherein said working machine is a construction excavator and wherein the working operation is construction excavation.

4. The system of claim 1 wherein at least two resting speeds may be selected, said selection means being further responsive to a change of a machine parameter such as hydraulic pressure or actual engine speed.

5. The system of claim 1 wherein said speed selection switch is a push-button;

said speed selection means shifting to a next higher one of said working speeds in response to momentary actuation of said push-button;

said speed selection means shifting to a next lower one of said working speeds when said push-button is depressed for at least a predetermined time duration.

6. The system of claim 5 wherein said push-button is mounted in a control lever of said working machine.

7. The system of claim 1 wherein said speed selection means is further responsive to said actual speed to prevent shifting between working speeds when the actual speed falls below a predetermined minimum speed.

8. The system of claim 1 wherein said driving means is an electromagnetic driving device.

9. The system of claim 1 wherein said driving means is a D.C. servo motor.

10. A device for setting at least one resting and at least two working speeds of a diesel engine in an excavator or the like, and including a manually operable control device adapted to provide electric setting signals which are applied to a driving device connected to the speed regulator lever of said diesel engine, said control device comprising:

means for setting the resting speed of the engine and shifting from the actual resting speed to a working speed when a working operation is being performed and for shifting, after a time delay, from the actual speed to a resting speed, when the machine makes no working movements, and means for setting the working speed of the engine and changing of the actual working speed stepwise to a higher or lower working speed by means of a manually operable switch means.

11. A device as claimed in claim 10, wherein said means for setting the resting speed includes at least two resting speed setting means, and a shifting device which, for shifting purposes, is operable by at least one of the manual control means of the working machine, a manually releasable signal, or a change in the hydraulic pressure or the speed of the engine, said shifting device having an output connected to said driving device and inputs connected to said resting speed setting means and to the means for setting the working speed of the diesel engine, in order to connect to said driving device either one of said speed setting means or said means for setting the working speed.

12. A device as claimed in claim 11, wherein said means for setting the working speed includes a control means having an output connected to one input of the shifting device, and at least two inputs connectible to said output, one of said inputs being connected to a manually settable means providing an output signal for a first working speed, said other input being connected to a means providing a prefixable output signal for a second working speed.

13. A device as claimed in claim 12, wherein said control means has a third input connectible to said output and connected to a signal converter connected to said manually settable means and providing an output signal for a third working speed.

14. A device as claimed in claim 13, wherein said control means is connected, for connection of a desired input to said output, to said manually operable switch means which is a push-button mounted in a control lever.

15. A device as claimed in claim 13, wherein said control means is adapted to sense the actual speed of the engine to prevent shifting between the working speeds when the speed of the engine falls below a predetermined minimum speed and to automatically connect the input connected to said manually settable means to its output.

16. A device as claimed in claim 10, wherein said driving device connected to the speed regulator lever is an electromagnetic driving device.

17. A device as claimed in claim 10, wherein said driving device connected to said speed regulator is a d.c. servo motor.

* * * * *